United States Patent [19]

Vrataric, Jr. et al.

[11] 3,952,661

[45] Apr. 27, 1976

[54] FLUIDIC FUZE

[75] Inventors: Frank Vrataric, Jr., Wheaton, Md.; James E. Forrest, Jr., Alexandria, Va.; Carl J. Campagnuolo, Potomac; Francis E. Blodgett, Silver Spring, both of Md.

[73] Assignee: The United States of America as represented by the Secretary of the Army, Washington, D.C.

[22] Filed: July 25, 1974

[21] Appl. No.: 491,897

[52] U.S. Cl. ..... 102/70.2 R; 102/70.2 G

[51] Int. Cl.[2] ..... F42C 11/00

[58] Field of Search ..... 102/70.2 G, 70.2 R

[56] References Cited

UNITED STATES PATENTS

| | | | |
|---|---|---|---|
| 2,682,047 | 6/1954 | Allen | 102/70.2 G |
| 2,699,543 | 1/1955 | Naumann et al. | 102/70.2 G |
| 3,712,170 | 1/1973 | Campagnuolo et al. | 102/70.2 G |
| 3,772,541 | 11/1973 | Campagnuolo et al. | 102/70.2 G |
| 3,792,664 | 2/1974 | Campagnuolo | 102/70.2 G |
| 3,853,063 | 12/1974 | Hoyt et al. | 102/70.2 R |

*Primary Examiner*—Charles T. Jordan

*Attorney, Agent, or Firm*—Nathan Edelberg; Robert P. Gibson; Saul Elbaum

[57] ABSTRACT

A fluidic-electronic time fuze for detonating illumination ammunition in a projectile is described. A ram air driven fluidic generator is used to provide both the time base and power to the electronics of the timing system as well as to sense a second signature for the safing and arming system within the projectile. The electronic circuit of the timing system comprises conventional digital counters and logic circuitry which senses output pulses from the fluidic generator. Thus the accuracy of the time fuze is dependent upon the resonant frequency of the diaphragm within the fluidic generator.

9 Claims, 6 Drawing Figures

FLUIDIC FUZE

RIGHTS OF THE GOVERNMENT

The invention described herein may be manufactured, used, and licensed by or for the United States Government for governmental purposes without the payment to us of any royalty thereon.

BACKGROUND OF THE INVENTION

1. Field of Invention

The present invention relates to a time fuze for detonating at a predetermined time illumination or other types of ammunition mounted within a projectile. More specifically, the present invention relates to a fluidic-electronic time fuze including a ram air driven fluidic generator which supplies both the time base and power to an electronic timing and control circuit within the projectile.

2. Description of Prior Art

The time base function for time fuzes for detonating illumination ammunition in projectiles has historically been fulfilled with pyrotechnic devices, the primary reason being the simplicity of the devices due to a minimum number of moving parts. Pyrotechnic fuzes are, however, subject to erratic behavior with respect to burning time. In addition, they are especially vulnerable to failure during extreme environmental conditions and extended storage periods.

Other prior art time fuzes have used electronic oscillators for generating the time base function in an electronic timer. However, these oscillators are quite often expensive and do not provide any additional safing signatures to the safing and arming device of the detonator.

Prior art time fuzes are also known which rely on stored power such as batteries of the thermal or electrolytic capsule type to drive the timing and detonating devices. These stored power sources are often unreliable and add unnecessary weight to the projectile.

Another alternative as a power source for prior art time fuzes has been the use of small air driven generators. An example of this type of generator is a rotatable armature generator which is driven by a propeller or a series of turbine blades in response to the flow of ram air through the projectile. However, these generators lack reliability and do not generate a voltage which is accurate enough to be used as a time base for the electronic timing and control circuitry of a time fuze.

SUMMARY OF THE INVENTION

Accordingly, it is an object of the present invention to provide a time fuze for detonating ammunition within a projectile wherein both an accurate time base and power are provided by a single inexpensive oscillator means.

It is a further object of the present invention to provide a time fuze which does not rely on stored power for its operation.

It is still a further object of the present invention to provide a time fuze which inherently provides added safing signatures to the safing and arming device of the detonator.

It is another object of the present invention to provide a highly reliable, accurate, and low cost time fuze which provides significant improvements over pyrotechnic devices used heretofore.

The objects of the present invention are fulfilled by providing in combination a fluidic generator and electronic timer digital logic circuitry for generating a timing signal for triggering a detonating device. The fluidic generator functions as both a time base for the timer and a power source for the timer and detonating device.

The fluidic generator is of the type which converts ram air passing through the projectile during flight into electrical energy of power. The power generated is a sinusoidal waveform whose frequency is dependent upon the resonance of the vibrating diaphragm. Since the diaphragm is a relatively high Q-device, its resonant frequency is substantially constant over a wide range of environmental conditions. Thus the fluidic generator provides a very accurate time base for use with the electronic timer circuitry of the present invention. A fluidic generator suitable for use with the present invention is described in U.S. Pat. No. 3,772,541 to Compagnuolo et al. issued Nov. 13, 1973. The details of the Compagnuolo et al. patent are incorporated herein by reference.

The digital logic circuitry for the timer of the present invention consists of conventional commercially available components such as standard integrated circuit chips. The logic circuitry is adapted to count the timing pulses generated by the fluidic generator and to trigger a detonator device in response to a predetermined number of pulses which is programmed into said circuitry by a time delay selection means.

The fluidic generator for use with the present invention provides an additional safing signature not present in prior art devices. This safing signature is a function of a ram air threshold which is responsive to a minimum projectile velocity. In other words the fluidic generator can be designed to preclude resonance of the diaphragm until the projectile velocity exceeds a minimum value. This prevents arming of short rounds and provides an additional safing signature for the safing and arming device.

BRIEF DESCRIPTION OF DRAWINGS

The objects of the present invention and the attendant advantages thereof will become more fully apparent by reference to the drawings wherein like numerals refer to like parts and wherein.

DETAILED DESCRIPTION OF THE DRAWINGS

Figure 1:
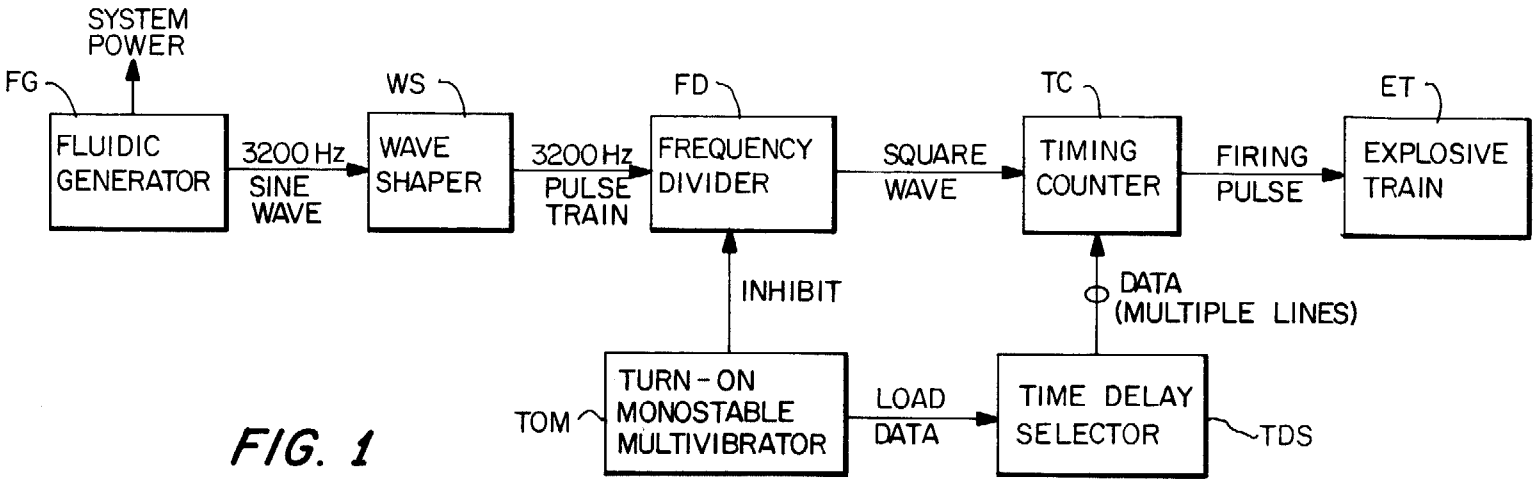
FIG. 1 is a schematic block diagram of the fluidice-lectronic time fuze of the present invention.

A block diagram of the fluidic time fuze is shown in FIG. 1. The system is comprised of six principal sections; fluidic separator, FG; wave shaper, WS; frequency divider, FD; time delay selector, TDS; timing counter, TC; and "turn-on" monostable multivibrator, TOM.

Fluid generator, FG, in a preferred embodiment is of the type described in U.S. Pat. No. 3,772,541 to Compagnuoto et al. issued Nov. 13, 1973. As described in that patent, ram air under pressure enters the generator nozzle and proceeds to a cavity, causing a mechanical resonance in the diaphragm at the rear of the cavity. The vibrating diaphragm changes the flux permeance of a magnetic transducer, thus generating an a.c. signal in the coil windings of the transducer. The induced voltage is used to power the fuze electronics and to provide an accurate time base for the electronic timer.

The generator utilized in the fluidic time fuze of the present invention is a miniature device that can generate a power output from 12 to 225 mw in the velocity range from 350 to 940 ft/sec. The power output is a function of pressure but an available power of even 0.5 mw at 0.25 psig (lowest anticipated velocity of 156 fps) is adequate to drive the fuze electronics. By changing the number of turns in the coil, the voltage output can be tailored to the electronic circuit design which is selected.

The fluidic generator FG provides a nearly 3200 Hz sine wave output which is the time base for the digital timing system. This sine wave is first processed by the wave shaping circuit WS and then becomes the "clock" signal for the frequency dividers, FD.

The use of a fluidic generator combines the advantages of mechanical and electronics features. The generator acts as a tuning fork. It resonates when excited and thus can be used as an accurate, stable time base. It also has another advantage in that the excitation source is controllable. It can be designed to preclude resonance until the projectile velocity exceeds a minimum value. This prevents arming of short rounds and provides an additional safing signature. The third advantage is the ability to convert mechanical energy (vibration) into electrical energy, thus eliminating the requirement for any stored energy, either electrical or pyrotechnical.

A wave shaper WS is coupled to the output of fluidic generator FG since digital circuits require waveforms having sharply defined logic levels. As an example, CMOS (Complementary Metal Oxide Semiconductor) integrated circuits employing a supply voltage of +10v define logic 0 as being less than +3.0v and logic 1 being greater than +7.0v. Signals between +30v and +7.0v will cause undefinable outputs and are therefore not allowed. In addition, many logic networks require input signals to have very sharp leading and trailing edges for proper operation. The Wave Shaper WS, of FIG. 1 which includes a fast Schmitt trigger, insures that the generator time base waveform satisfies these requirements by changing it from a sine wave into a square wave pulse train.

The frequency divider FD of FIG. 1 coupled to the output of generator FG comprises a plurality of frequency dividers. These frequency dividers are described in more detail with reference to FIG. 5. Since the frequency of the sine wave generated by fluidic generator FG in a preferred embodiment is nominally 3200 Hz, the frequency is divided down by frequency divider FD by a factor of 3200 to 1 Hz, so that the timing counter TC receives only 1 pulse per second. This allows for one second resolution in the time setting for the fuze.

The time circuit of FIG. 1 further includes timing counters TC which may comprise programmable binary counters having 6 bit (64 state) resolution, where each bit equals 1 second. Each pulse from frequency divider FD advances counter TC by 1 bit.

The time delay selector TDS of FIG. 1 programs counter TC to control the number of pulses required from frequency divider FD to cause a firing pulse to be initiated from counter TC to the detonation means of explosive train ET. The details of time delay selector TDS will be described hereinafter with reference to FIGS. 2 to 6.

The system of FIG. 1 is further provided with a turn-on monostable multivibrator TOM which is coupled to both frequency divider FD and time delay selector TDS. The function of multivibrator TOM is to turn on time delay selector TDS when the projectile is first fired and to inhibit the operation of frequency divider FD until programmable counter TC is set by selector TDS and until fluidic generator FG comes up to substantially full power.

Before the projectile is fired, there is no electrical power available to the electronic logic circuitry from generator FG. When generator FG power comes up to power as the projectile accelerates, the initial state of the electronic circuitry must be controlled. The turn-on monostable multivibrator provides the signal necessary to control the turn-on operation of the electronic circuitry.

Fluidic generator FG takes approximately 2ms to come up to 90% of the required supply voltage. The period of the turn-on monostable therefore has been selected in a preferred embodiment to be ten times greater than this, or 20 ms. During this 20 ms time, the output from the monostable TOM provides a control signal which inhibits the frequency divider FD, i.e., the frequency divider FD does not divide the generator output frequency and therefore does not provide pulses to timing counter TC. In this interval, the data bits from time delay sector TDS are decoded and gated by the monostable output of TOM and used to set the programmable counter TC. When the timing period of monostable multivibrator TOM ends, the inhibit signal to FD is disabled. The frequency divider FD then begins to divide the generator frequency and the programmable counter TC senses the pulses coming from frequency divider FD and adds them to the initial state which was programmed by the time delay selector TDS.

The time delay selector section of FIG. 1, shown in detail in FIGS. 2 to 5, consists of three main parts. The first is a printed circuit board coding wheel of FIG. 3 which is used to select the desired time delay; the second is the electronic logic of FIG. 5 necessary to convert the desired time delay data on the coding wheel into a format suitable for the timing section, and the third is the gating logic used to control the transmission of the data to the timing section.

The fluidic fuze of the present invention uses digital logic to carry out the timing function. This means that setting any required time delay must be done using binary numbers (or "bits") in the form of switch closures; analog control voltages or currents can not be used to control digital circuits. The number of binary bits which must be specified in order to choose a given time delay is dependent upon two factors: maximum time delay necessary and resolution within this total time.

Figure 2:
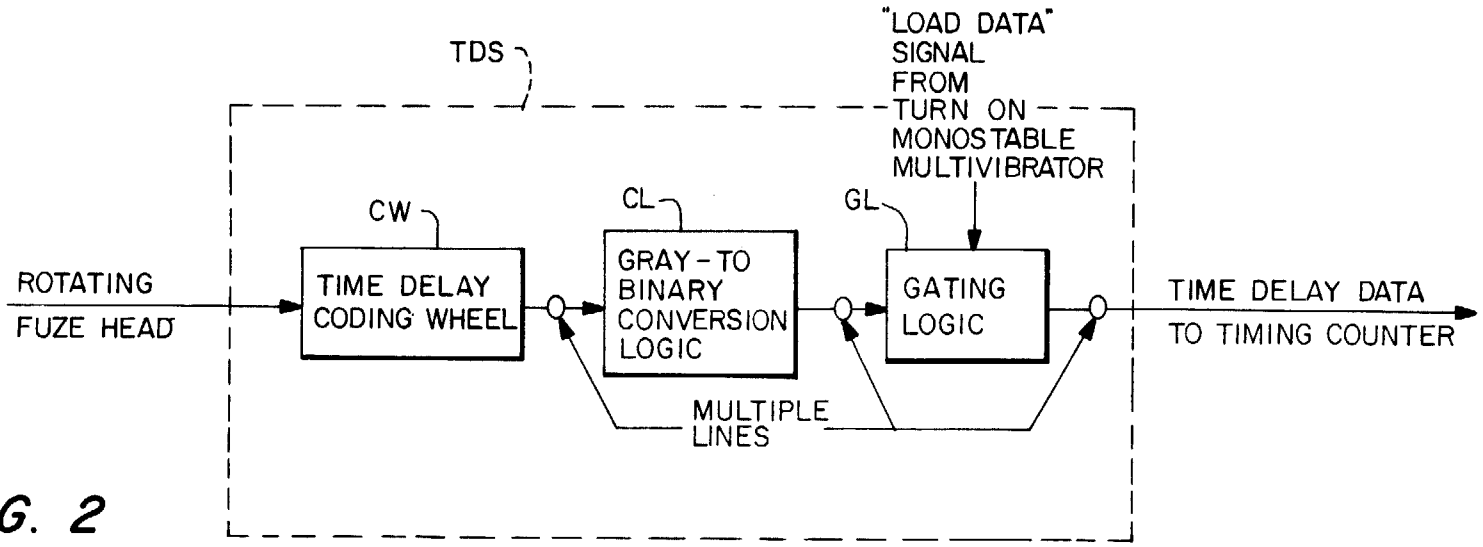
FIG. 2 is a schematic block diagram of the time delay selection means of the present invention.

The three main components of timing selector TDS are generally illustrated in the block diagram of FIG. 2. As illustrated therein time delay coding wheel CW is mounted in juxtaposition with a rotating fuze head carrying a plurality of electrical contacts which selectively engage a like number of conductive tracks on coding wheel CW. The details of these contacts and coding wheel CW will be further described hereinafter with reference to FIGS. 3 and 4.

Coding wheel CW in cooperation with the electrical contacts of the fuze head generate a gray code which is transmitted to conversion logic CL. Conversion logic CL decodes the gray code and generates a binary code through gating logic GL to timing counter TC in response to a control signal from monostable TOM. The binary code generated by conversion logic CL functions to program counter TC to generate a firing pulse in response to a selected number of pulses from frequency divider FD.

Figure 3:
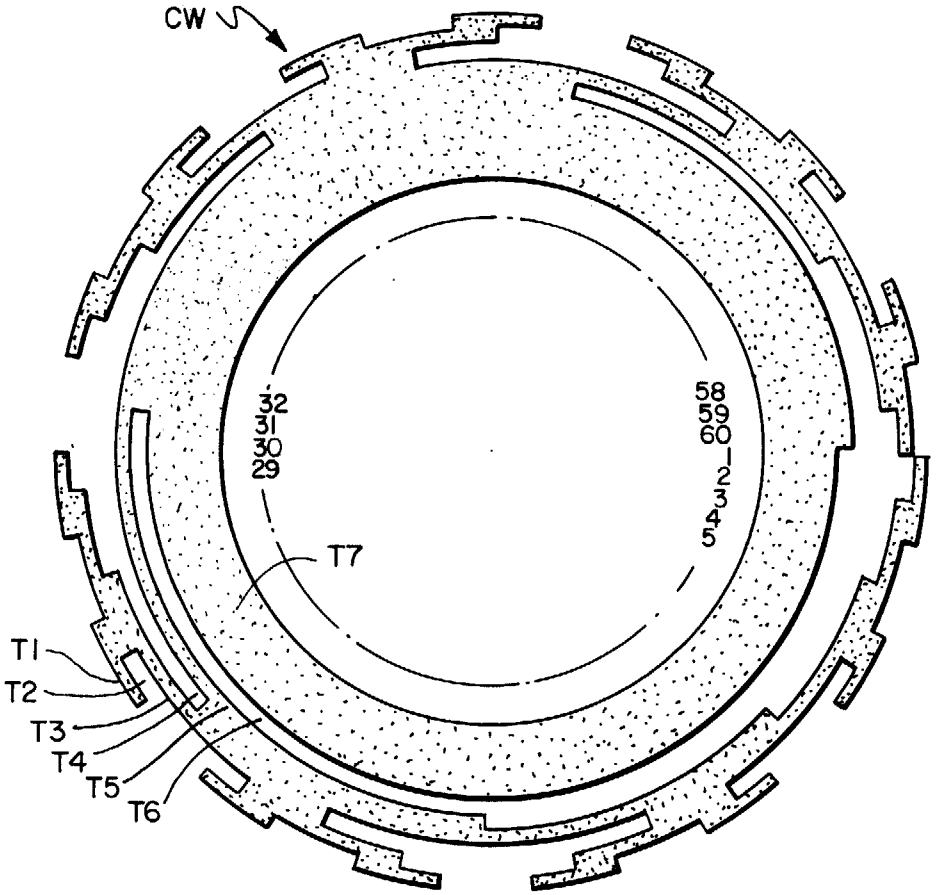
FIG. 3 is a top plan view of a coding wheel suitable for use with the time delay selection means of FIG. 2.

Selecting the desired time delay is done by rotating the fuze head with respect to the projectile body; the time delay is a direct function of this angular position. A printed circuit time delay coding wheel CW with conducting tracks is mounted within the projectile fuze head which contains electrical contacts that sweep around the coding wheel. A typical example of a coding wheel circuit board is shown in FIG. 3. This particular board has six data tracks T1 to T6 and a common ground track T7 on different radii; these correspond to six binary bits of data. Six bits of data can provide 64 ($2^6$) unique settings; however, only 60 settings are needed. Each setting occupies a six degree sector of the wheel, and corresponds to time delays from one to 60 seconds. The darkened areas on the board represent conducting paths to electrical ground, while the white areas represent open-circuit or non-conducting paths. Seven contact brushes, corresponding to the six data bits and the common ground connection, sweep over the tracks as the fuze head is rotated. The data which is detected is then conducted back to the conversion logic CL.

Figure 4:
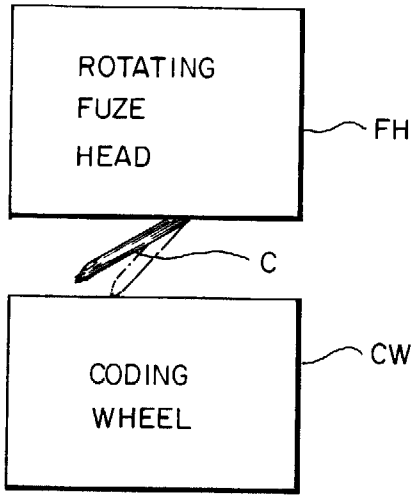
FIG. 4 is a side elevational view of the contact arrangement for use with the coding wheel of FIG. 3.

As shown in FIG. 4 the contacts C on the fuze head FH are normally spring biased away from contact with wheel CW. However, when the projectile is fired the setback forces generated by the acceleration of the projectile constrain contacts C downwardly until contact is made with wheel CW. Only one contact is shown in FIG. 4 for the purposes of illustration. However, it should be understood that seven such contacts are present in the preferred embodiment of the present invention. This design feature provides an additional safing and arming signature to the fluidic fuze, since time delay selector TDS can not function until the projectile is fired to constrain contacts C into engagement with coding wheel CW.

The contacts C in cooperation with wheel CW and suitable voltage sources in circuit therewith generate a gray encoded decimal number.

From Table I it can be seen that a Gray encoded decimal number changes only one bit from one number to the next; the other bits remain constant. Contact misalignment can therefore produce a maximum error of + 1 bit. Wheel CW is encoded with a Gray code; this can be verified by carefully observing the patterns of metal in each sector. The first formula listed below Table I gives a method for numerically converting from natural binary to this Gray code.

TABLE I

| DECIMAL | Code Conversions 8-4-2-1 BINARY | GRAY |
|---|---|---|
| 0 | 0000 | 0000 |
| 1 | 0001 | 0001 |
| 2 | 0010 | 0011 |
| 3 | 0011 | 0010 |
| 4 | 0100 | 0110 |
| 5 | 0101 | 0111 |
| 6 | 0110 | 0101 |
| 7 | 0111 | 0100 |
| 8 | 1000 | 1100 |
| 9 | 1001 | 1101 |
| 10 | 1010 | 1111 |
| 11 | 1011 | 1110 |
| 12 | 1100 | 1010 |
| 13 | 1101 | 1011 |
| 14 | 1110 | 1001 |
| 15 | 1111 | 1000 |

NOTE:
Define the Binary Number as $C = C_n C_{n-1} \ldots C_o$
Define the Gray Coded Number as $G = G_n G_{n-1} \ldots G_o$
Then:
a) Conversion from Binary to Gray:
$G_i = C_{i+1} \oplus C_i$ ; $i = 0, 1, 2, \ldots n + 1$
b) Conversion from Gray to Binary:
$C_n = G_n$
$C_i = C_{i+1} \oplus G_i$ ; $i = 0, 1, 2, \ldots n - 1$ Once a given time delay has been selected by rotating fuze head FH the Gray encoded number is converted back into natural binary so that the timing counter TC can interpret it. The second formula listed in Table I indicates the procedure to accomplish this which consists of serial binary addition of the Gray number and the resultant natural binary number, with the carries being discarded. The addition is carried out by a series of Exclusive-Or gates in the conversion logic CL of this section. The result, the natural binary number corresponding to the desired time delay, becomes an input to the gating logic.

Figures 5, 6:
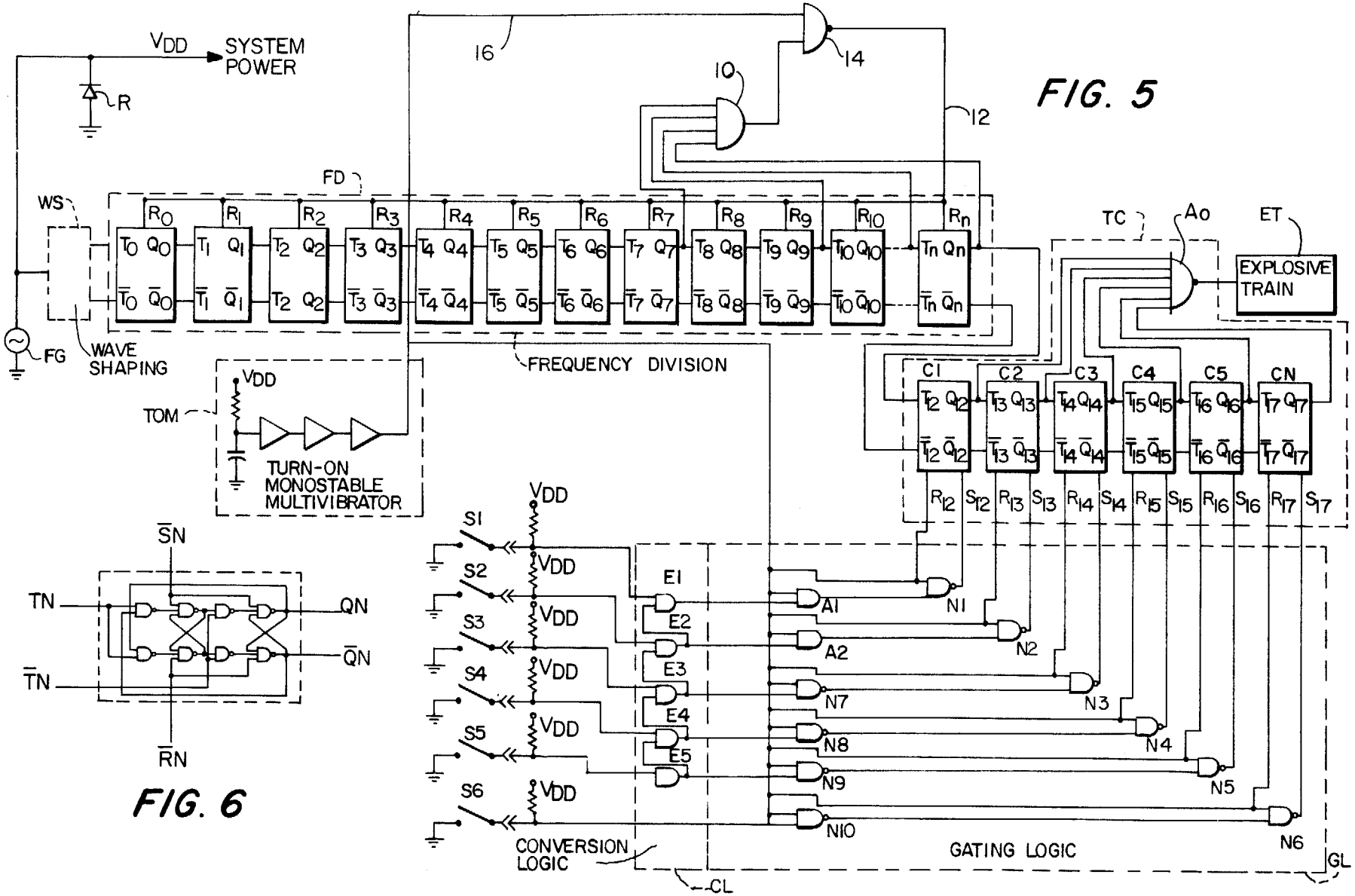
FIG. 5 is a circuit diagram of a suggested embodiment of the electronic circuit components used in the block diagram of FIG. 1.
FIG. 6 is a logic diagram of a typical toggle flip flop suitable for use in the system of the present invention.

Referring to FIG. 5 there is illustrated a logic circuitry schematic for the electronic circuitry of the present invention including the wave shaper WS, the frequency divider FD, timing counter TC, conversion logic CL, gating logic GL, and turn-on monostable TOM. In a preferred embodiment all of the electronic elements are disposed on a single CMOS (complementary Metal Oxide Semiconductor) integrated circuit chip. The system of FIG. 5 contains only a few external components. The number of input/output connections to the chip is 10: six for the data bits from the coding wheel CW, two for power and ground, one for the unrectified fluidic generator time base signal and one for the SCR (not shown) which fires the explosive train. In addition to being compact, CMOS integrated circuits consume only microwatts of electrical energy.

The design and fabrication of custom integrated circuits has advanced so markedly in recent years that this circuit is simple to produce. The level of complexity is well within present state of the art capabilities, so the size of the chip can be small, with few interconnections. These factors contribute to lowering the cost of the fluidic fuze.

Referring in more detail to FIG. 5 there is shown a fluidic generator FG having one output coupled to the input of a wave shaper WS. WS is a well known Schmidt trigger circuit which converts a sinusoidal wave form into a square wave. The output of the wave shaper is coupled to the input of frequency divider FD.

A second output of fluidic generator FG is coupled through a rectifier R to generate a D.C. output $V_{DD}$ which provides power to both the timing circuitry and the explosive train detonator.

The frequency divider circuit of FIG. 5 is comprised of a series of toggle flip-flops $R_o$ to $R_n$ with digital feedback. It serves to digitally divide the generator frequency down to a repetition rate compatible with the timing needs. For example, if the timer requires one second resolution, then the output of the frequency dividers is one pulse per second.

A typical toggle flip flop stage is shown in FIG. 6 and includes eight NAND gates; inputs $T_N$, $\overline{T}_N$; outputs $Q_N$, $\overline{Q}_N$; set terminal $\overline{S}_N$; and reset terminal $\overline{R}_N$. This type of flip flop and its operation are well known in the art.

The toggle flip-flops divide the frequency down by successive factors of two. The number of flip-flops, $n$, utilized is determined in the following manner. If, as an example, one pulse every five seconds is the required output of the frequency divider, the 3,200 Hz base frequency of the generator must be divided by 16,000. The nearest binary power of two greater than 16,000 is $2^{14}$, which is equal to 16,384. Fourteen stages of binary division are therefore required. Then, to divide by the exact number 16,000, which is $11111010000000_2$ in binary format, the outputs of the eighth and 10th through nth stages are connected to an AND gate 10.

The AND gate output goes to "one" when 16,000 is reached, simultaneously toggling the timing section through NAND gate 14 and line 12 and resetting the flip-flops of the frequency dividers. The dividers then repeat the process, and in this manner, one pulse every five seconds becomes the input to the timing counter TC.

The timing counter TC has two basic parts: a programmable binary counter and an AND gate $A_o$. The programmable binary counter is comprised of a series of a serial chain of toggle flip-flops C1 to CN similar to those used in the frequency division section. The basic difference between these flip-flops and those in the frequency division section is that the initial states of these flip-flops are programmed by the data bits from the time delay selection section. There is one flip-flop for each bit of data on the coding wheel CW; i.e. if there are six tracks on the wheel, corresponding to six bits of data, there will be six flip-flops in the programmable counter. These flip-flops are set at the beginning of the timing cycle to the 1's complement of the desired time delay data and the pulses from the frequency division section are added by the counter to that number. The AND gate $A_o$ detects when all of the flip-flop stages have 1 outputs, thus indicating completion of the timing period. The AND gate output signal is used to trigger an SCR (not shown) which fires a detonator in the explosive train ET.

The coding wheel CW of FIG. 3 is shown diagrammatically in FIG. 5 as a plurality of switches S1, S2, S3, S4, S5, S6. The switches in the open circuit positions shown correspond to gray code logic 1 while the closed positions correspond to gray code logic 0. The outputs of switches S1 to S6 are connected to the input of the gray-to-binary conversion logic CL.

Conversion logic CL includes five exclusive or gates E1, E2, E3, E4, E5 which convert the gray code logic to binary logic in the manner as illustrated in Table I above.

The output of the conversion logic CL is coupled to the input of gating logic GL. Gating logic GL is also coupled to the output of monostable TOM. Gating logic GL includes ten NAND gates N1 to N10 and two AND gates A1, A2 connected as shown to transmit the binary logic to counter TC. The gating logic is enabled by a control signal from monostable TOM to permit the passage of the binary logic from CL to TC in response to the generation of a pulse from monostable TOM.

MONOSTABLE TOM is turned on in response to the acceleration of the projectile.

System Operation

To demonstrate the operation of this system assume an illuminating mortar round with a timing capability from 1 to 60 seconds in 1 second intervals. For this system the output from the frequency divider FD to the programmable counter TC as previously discussed is one pulse per second. The power of "two" closest to the number sixty is $2^6$ or 64, so a 6 bit coding wheel similar to that shown in FIG. 3 is used. The time delay corresponding to the zero state and the last three Gray code states are not used on the wheel CW because a zero delay and delays above 60 seconds are not required. Each time delay on the wheel CW therefore has a sector 6° wide.

Assume that a 9 second setting is required for the fuze. The fuze head must be rotated nine seconds times 6° per second, which equals 54°. A slight mechanical detent every 30° (5 seconds) is included between the fuze head and the fuze body to facilitate ease of time setting. When the round is fired, the safing and arming device (not shown) is activated on setback and within 2 ms the fluidic generator supplies power to the circuitry. The turn-on monostable holds the frequency dividers reset for 20 ms until the power supply transients are over. During this interval, the time delay selector TDS reads and decodes the desired time delay as $001001_2$, or $9_{10}$ seconds. The 1's complement of this number, $110110_2 = 54_{10}$ seconds, is retained in the programmable counter TC at the end of the 20 ms period. The output pulses from the frequency divider (1 Hz) are then added by the programmable counter to the initial count $110110_2$. When the counter TC reaches the state $111111_2 = 63_{10}$, the AND gate $A_o$ output goes to 1, and the explosive train is fired. The time delay was $111111_2 - 110110_2 = 001001_2 = 9_{10}$ seconds.

We wish it to be understood that we do not desire to be limited to the exact details of construction shown and described, for obvious modifications can be made by a person skilled in the art.

What is claimed is:

1. A time fuze for firing an explosive train in a projectile at a predetermined time after said projectile is fired comprising in combination:

a. a fluidic generator means for generating an electrical signal in response to the flow of ram air into said fluidic generator means, said electrical signal having a characteristic resonant frequency;

b. electrical circuit means coupled to said fluidic generator means for generating an output pulse in response to the receipt of a selected number of cycles of said electrical signal;

c. time delay selection means coupled to said electrical circuit means for controlling said selected number of cycles to which said circuit means responds to generate said output pulse; and d. detonating means for receiving said output pulse and for firing said explosive train in said projectile in response thereto.

2. The time fuze in claim 1 wherein said fluidic generator means includes output means for supplying electrical power to both said detonating means and said electric circuit means.

3. The time fuze of claim 1 wherein said electrical circuit means comprises:

a. means for shaping said electrical signal into a series of pulses having a frequency which is a function of said resonant frequency; and b. counting means for counting said pulses and for generating said output pulse in response to the receipt of a selected number of said pulses.

4. The time fuze of claim 3 wherein said electrical circuit means further includes frequency divider means for decreasing the frequency of said pulses transmitted to said counting means to a predetermined level.

5. The time fuze of claim 1 wherein said fluidic generator includes means generator to inhibit the generation of said output signal until the velocity of said ram air exceeds a predetermined threshold.

6. The time fuze of claim 4 including means for initially inhibiting the operation of said frequency divider means after said projectile is fired for a predetermined period and for enabling the flow of data from said time delay selection means to said counting means during said period.

7. The time fuze of claim 6 wherein said means for inhibiting comprises a monostable multivibrator which generates an output pulse for said predetermined period in response to the acceleration of said projectile.

8. The time fuze of claim 1 wherein said time delay selection means includes means to inhibit the operation thereof until said projectile has a predetermined level of acceleration imparted thereto.

9. The time fuze of claim 1 wherein said fuze includes a rotatable head and said time delay selection means comprises a coding wheel which is adjusted by rotating said head.

* * * * *